US009732452B2

(12) United States Patent
Yoshida et al.

(10) Patent No.: US 9,732,452 B2
(45) Date of Patent: Aug. 15, 2017

(54) STRETCH KNITTED FABRIC AND CLOTHES

(75) Inventors: Yuji Yoshida, Tokyo (JP); Mayumi Notsu, Tokyo (JP)

(73) Assignee: ASAHI KASEI FIBERS CORPORATION, Osaka (JP)

( * ) Notice: Subject to any disclaimer, the term of this patent is extended or adjusted under 35 U.S.C. 154(b) by 659 days.

(21) Appl. No.: 14/347,395

(22) PCT Filed: May 21, 2012

(86) PCT No.: PCT/JP2012/062950

§ 371 (c)(1),
(2), (4) Date: Mar. 26, 2014

(87) PCT Pub. No.: WO2013/046796

PCT Pub. Date: Apr. 4, 2013

(65) Prior Publication Data

US 2014/0238084 A1 Aug. 28, 2014

(30) Foreign Application Priority Data

Sep. 29, 2011 (JP) ..... 2011-215038

(51) Int. Cl.
*D04B 1/28* (2006.01)
*D04B 21/18* (2006.01)
(Continued)

(52) U.S. Cl.
CPC ..... *D04B 1/28* (2013.01); *D04B 1/18* (2013.01); *D04B 1/24* (2013.01); *D04B 21/18* (2013.01); *D04B 21/207* (2013.01)

(58) Field of Classification Search
CPC ... D04B 1/28; D04B 1/18; D04B 1/24; D04B 21/18; D04B 21/207
See application file for complete search history.

(56) References Cited

U.S. PATENT DOCUMENTS 5,708,118 A * 1/1998 Seneker ..... C08G 18/12 528/61
5,843,357 A 12/1998 Seneker et al.
(Continued)

FOREIGN PATENT DOCUMENTS

EP 1 087 047 A2 3/2001
JP 58-81661 5/1983
(Continued)

OTHER PUBLICATIONS

Extended European Search Report for EP Application No. 12836668.9 dated Jun. 20, 2014.
(Continued)

*Primary Examiner* — Danny Worrell
(74) *Attorney, Agent, or Firm* — Finnegan, Henderson, Farabow, Garrett & Dunner, LLP

(57) ABSTRACT

The present invention pertains to a stretch knitted fabric which exhibits an instantaneous temperature rise when stretched and which, by the repetition of stretching and relaxation, lastingly generates heat when stretched. A stretch knitted fabric which is composed of a non-elastic yarn and an elastic yarn, characterized in that the instantaneous temperature rise caused by heat generation at 100% warpwise and/or weftwise stretching is 1.0° C. or more.

7 Claims, 1 Drawing Sheet

(51) Int. Cl.

| | |
|---|---|
| ***D04B 1/18*** | (2006.01) |
| ***D04B 1/24*** | (2006.01) |
| ***D04B 21/20*** | (2006.01) |

(56) References Cited

U.S. PATENT DOCUMENTS

| | | | | |
|---|---|---|---|---|
| 6,263,707 | B1 * | 7/2001 | Miller | D04B 1/18<br>66/171 |
| 2006/0030229 | A1 * | 2/2006 | Fukuoka | D04B 1/16<br>442/197 |

FOREIGN PATENT DOCUMENTS

| | | |
|---|---|---|
| JP | 2004-124315 | 4/2004 |
| JP | 2004-211254 | 7/2004 |
| JP | 2004-232100 | 8/2004 |
| JP | 2010-189795 | 9/2010 |
| JP | 2010-281013 | 12/2010 |
| JP | 2012-112078 | 6/2012 |

OTHER PUBLICATIONS

Landsberg, G.S., Textbook of Elementary Physics, vol. 1, pp. 203-206 (Oct. 19, 1984).

Office Action for RU Patent Application No. 2014117171 dated Jul. 14, 2015.

International Search Report from the Japanese Patent Office for International Application No. PCT/JP2012/062950, mailing date Jul. 3, 2012.

* cited by examiner

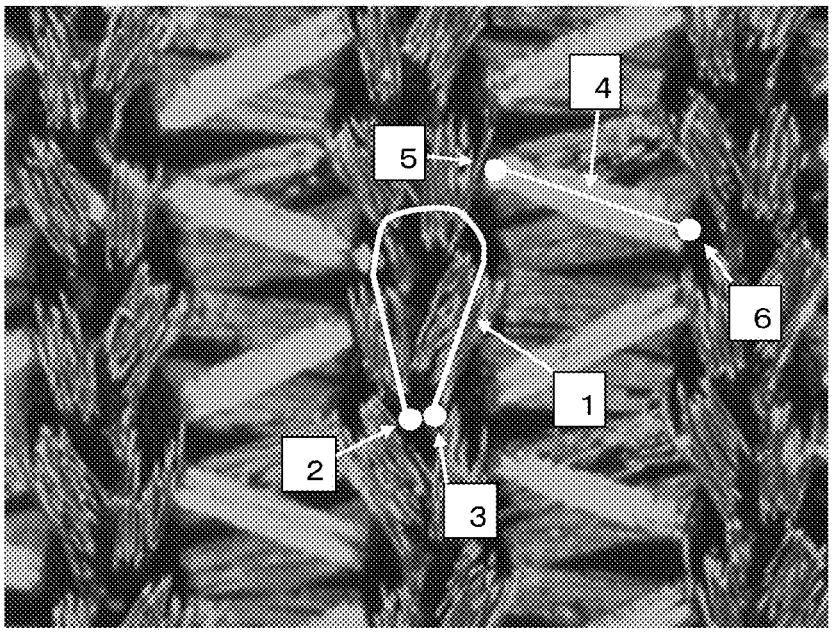
4
5
6
1
2
3

STRETCH KNITTED FABRIC AND CLOTHES

TECHNICAL FIELD

The present invention provides a stretchable knitted fabric that is a fabric containing an elastic yarn, in which the temperature instantaneously rises when stretched, and a warm garment using the knitted fabric.

BACKGROUND ART

Conventionally, clothes produced from a fabric having mixed therein a hygroscopically heat-generating fiber such as cellulose and capable of generating heat upon insensible perspiration or sweating from a human body wearing the garment are known as clothing exhibiting a temperature rise during wear, such as thermal clothing (see, for example, Patent Document 1). However, when the moisture absorption amount of the fiber reaches saturation, the hygroscopically heat-generating fiber does not generate heat any more and not only the heat generation time is short but also after the moisture absorption amount reaches saturation, the wearer may feel cold due to water in the fiber. Furthermore, as a heat-generating fabric and a heat-generating garment utilizing other than heat generation by absorption of moisture, it is known, for example, to incorporate a heater such as sheet heating element and linear heating element into the clothing, but in all cases, heat is generated by electricity, and the garment is heavy and requires an electrode, resulting in a garment that hinders smooth movement.

In this way, clothing rising in temperature during wear, which is comfortable and lightweight, is found nothing other than hygroscopic heat generation, but a hygroscopically heat-generating fabric is bound by the restriction of absorbing moisture and therefore, is limited in its hygroscopic heat generation. Thus, comfortable lightweight clothing capable of permanently generating heat when worn as a garment has not been discovered.

RELATED ART

Patent Document

Patent Document 1: Japanese Unexamined Patent Publication No. 2003-227043

SUMMARY OF THE INVENTION

Problems to be Solved by the Invention

An object of the present invention is to provide a stretchable knitted fabric ensuring that in a knitted fabric containing an elastic yarn, the temperature is instantaneously rises when stretched and by repeating the stretching and shrinking of the knitted fabric, heat is permanently generated when stretched. Another object of the present invention is to provide a product obtained by sewing the stretchable knitted fabric into an innerwear, sportswear or the like and expected to achieve warmth retention, prevent injury by warming a muscle or joint in the extension region, and exert a fat combustion effect.

Means to Solve the Problems

As a result of intensive studies to attain the above-described objects, the present inventors have found that the objects can be attained by a stretchable knitted fabric composed of a non-elastic yarn and an elastic yarn, wherein the instantaneous heat generation temperature when stretched by 100% is 1.0° C. or more. The present invention has been accomplished based on this finding.

That is, the present invention is as follows.

(1) A stretchable knitted fabric comprising a non-elastic yarn and an elastic yarn, wherein the instantaneous heat generation temperature when stretched by 100% in at least one of warp and weft directions of the knitted fabric is 1.0° C. or more.

(2) The stretchable knitted fabric according to (1) above, wherein the elastic yarn is contained in an amount of 40 g/m$^2$ or more and the power of knitted fabric stretched by 95% in at least one of warp and weft directions of the knitted fabric, as measured by the following method, is 2.5 N or more:

Measurement of power of knitted fabric stretched by 95%:

the knitted fabric in the state of being stretched by 30% of the initial length is set on a tensile tester and assuming that the stress value here is 0, the stress value (N) when further stretched by 50% based on the length at the setting (stretched by 95% in all of the initial length of the knitted fabric) is measured and taken as the power of knitted fabric stretched by 95%.

(3) The stretchable knitted fabric according to (1) or (2) above, wherein the ratio (Lb/La) between the length La obtained by adding the length of sinker loop of the elastic yarn and the length of needle loop of the non-elastic yarn in one unit of the knit structure when the knitted fabric is stretched by 30% in both warp and weft directions, and the length Lb obtained by adding the length of sinker loop of the elastic yarn and the length of needle loop of the non-elastic yarn in one unit of the knit structure when the knitted fabric is further stretched in either one of warp and weft directions to 50% stretch satisfies the following formula (1):

$$1.25 \leq Lb/La \leq 1.8 \quad (1)$$

(4) The stretchable knitted fabric according to any one of (1) to (3) above, wherein the stretch-heat generation index represented by the following formula is from 0.5 to 4.0:

Stretch-heat generation index=(weight of elastic yarn×power of knitted fabric stretched by 95%)/elongation degree of knitted fabric (wherein the weight of elastic yarn is the weight (g/m$^2$) of elastic yarn per unit area of the knitted fabric, the power of knitted fabric stretched by 95% is the power (N) of knitted fabric stretched by 95% as measured by the method above, and the elongation degree of knitted fabric is the elongation degree (%) of knitted fabric under a load of 9.8 N/knitted fabric of 2.5 cm in width).

(5) The stretchable knitted fabric according to any one of (1) to (4) above, wherein the elongation degree of knitted fabric in the direction causing stretch-heat generation is from 70 to 200% and the sum of warp and weft elongation degrees of the knitted fabric is from 170 to 450%, under a load of 9.8 N.

(6) The stretchable knitted fabric according to any one of (1) to (5) above, wherein at least a part of the elastic yarn is organized in a looping structure.

(7) The stretchable knitted fabric according to any one of (1) to (6) above, wherein the elastic yarns are fixed each other at the intersection of the elastic yarns.

(8) The stretchable knitted fabric according to any one of (1) to (7) above, wherein the power of the elastic yarn stretched by 100% is from 0.04 to 0.20 cN/dtex.

(9) A garment obtained by using the stretchable knitted fabric according to any one of (1) to (8) above, which closely attaches to a body to cover at least the joint region.

(10) The garment according to (9) above, wherein the garment is at least one member selected from bottoms, tops, legs, supporters and gloves.

Effects of the Invention

The garment using the stretchable knitted fabric of the present invention is warm and excellent in warmth retention due to heat generation by 1° C. or more of the knitted fabric upon bending or stretching the knee or arm and at the same time, has an effect of preventing injury by warming the muscle in the extension region, as well as a fat combustion effect. Furthermore, when the garment is worn during exercise in the winter season, reduction in the muscle temperature can be prevented by the heat generation and in turn, it can be expected that the athletic function is prevented from reduction due to a drop in the muscle temperature and the injury pain such as knee pain is prevented and relieved. In addition, a garment resistant to losing its shape during wear and washing can be formed. As for the shape loss during wear and washing, the dimensional change by washing is evaluated in accordance with the method of JIS L0217 103, and when the ratio of dimensional change due to washing is 3.0% or less in both the warp direction and the weft direction, the garment is judged to be resistant to losing the shape during both wear and washing.

BRIEF DESCRIPTION OF THE DRAWINGS

The drawing is a view for explaining the method to measure the length of needle loop of the non-elastic yarn and the length of sinker loop of the elastic yarn.

MODE FOR CARRYING OUT THE INVENTION

The present invention is described in detail below.

The stretchable knitted fabric of the present invention is composed of a non-elastic yarn and an elastic yarn and produced by a warp knitting machine or a circular knitting machine and is characterized in that the instantaneous heat generation temperature when stretched by 100% (hereinafter, referred to stretch-heat generation) in at least either one of warp and weft directions of the knitted fabric is 1.0° C. or more.

The instantaneous heat generation temperature as used in the present invention is a value calculated as the difference from the temperature of the knitted fabric before the start of test by measuring the maximum temperature shown by the knitted fabric while performing repeat stretching/shrinking 100 times, with one stretching/shrinking being an operation of stretching the stretchable knitted fabric by 100% and then relaxing the knitted fabric to the original length, under the conditions of receiving no energy supply from the outside except for stretching/shrinking.

When during 100% stretching/shrinking or immediately after the completion of stretching/shrinking, which is performed 100 times, the temperature of the knitted fabric becomes higher than the temperature of the knitted fabric before the start of test, this indicates occurrence of instantaneous heat generation. In the stretchable knitted fabric of the present invention, the instantaneous heat generation temperature measured by this method must be 1.0° C. or more. If the instantaneous heat generation temperature is less than 1.0° C., the wearer can hardly perceive the generation of heat, and the object of the present invention cannot be achieved. The instantaneous heat generation temperature is preferably 1.5° C. or more, more preferably 2.0° C. or more. As the instantaneous heat generation temperature is higher, the wearer is more comfortable, and the upper limit is not particularly limited as long as the temperature does not adversely affect the human body, but if the content of elastic fiber is too much increased so as to raise the instantaneous heat generation temperature, the knitted fabric develops high power and hinders smooth movement when formed into a garment. Therefore, the instantaneous heat generation temperature is preferably 10° C. or less. Also, it may be sufficient if the instantaneous heat generation temperature when stretched by 100% in at least one direction out of warp and weft directions of the knitted fabric is 1.0° C. or more, and in the case of a Knitted fabric where the instantaneous heat generation temperature in both the warp and weft directions of the knitted fabric is 1.0° C. or more, the cutting direction at the sewing to a product may not be taken into consideration, but in the case of a knitted fabric where the instantaneous heat generation occurs only in one direction, the direction particularly in which large stretch of the skin at the joint of human body occurs is arranged to conform to the direction in which the instantaneous heat generation of the knitted fabric is large, whereby a garment keeping warmth during the athletic activity can be produced.

Incidentally, the measurement of heat generation temperature is specifically described in Examples.

The conventional knitted fabric containing an elastic yarn provides a comfortable fit/feel during wear of a garment by imparting stretchability to the knitted fabric and in turn, enables obtaining a slim and aesthetic garment or enhancing the athletic function. On the other hand, in the present invention, a knitted fabric caused to generate heat by stretching/shrinking is obtained, and this is a knitted fabric based on an idea completely different from conventional products. In order to achieve an instantaneous heat generation temperature of 1° C. or more when stretched by 100%, the content of the elastic yarn, the knitted fabric design such as power and loop texture of the knitted fabric, and the production method of the knitted fabric for efficiently exerting the stretch-heat generation are important. A stretchable knitted fabric achieving an instantaneous heat generation temperature of 1° C. or more when stretched by 100% is first obtained by the present invention, and when worn as clothing, even slight stretching of 30 to 50% that is the stretch amount of a joint of human body during wear is accompanied by high heat generation, making it possible to realize heat generation during wear.

In the stretchable knitted fabric of the present invention, in order to achieve an instantaneous heat generation temperature of 1° C. or more when stretched by 100%, 40 g/m$^2$ or more of elastic yarn is preferably incorporated into the knitted fabric and as a larger amount of elastic yarn is incorporated, the heat generation temperature becomes higher. The content of elastic yarn is more preferably 50 g/m$^2$ or more, still more preferably 55 g/m$^2$ or more. However, if the content of elastic yarn is too large, the weight of the knitted fabric is increased or the knitted fabric develops high power and hinders smooth movement when formed into a garment. Therefore, the content of elastic yarn is preferably 200 g/m$^2$ or less.

The ratio between the elastic yarn and the non-elastic yarn in the knitted fabric is not particularly limited, but the ratio (mixing ratio) of the elastic yarn is preferably from 20 to 65%, more preferably from 25 to 60%, still more preferably from 30 to 55%. If the ratio of the elastic yarn exceeds 65%, the dye fastness may deteriorate or the knitted fabric may fail in having sufficient strength, whereas if the ratio of the elastic yarn is less than 20%, an adequate stretch-heat generation effect cannot be brought out.

In the stretchable knitted fabric of the present invention, the effects of the present invention are not exerted only by the above-described content of the elastic yarn, and it is important that the elastic yarn is efficiently stretched by the action during wear as clothing. That is, in the conventional knitted fabric containing an elastic yarn, the elastic yarn is meandering or curving in the knitted fabric and when the knitted fabric is stretched, the meandering or curving of the elastic yarn is straightened to make the elastic yarn straight. Furthermore, loop slippage occurs at the intersection of needle loop and sinker loop, and the needle loop or sinker loop becomes small depending on the stretch direction, i.e., loop deformation occurs while the needle loop and the sinker loop are not changed in the length. After such a change, the elastic yarn is stretched and therefore, this structure is very inefficient in obtaining stretch-heat generation targeted in the present invention.

On the other hand, in the stretchable knitted fabric of the present invention, the meandering or curving of the elastic yarn in the knitted fabric is of a very small degree, and stretching of the knitted fabric leads to efficient stretching of the elastic yarn, as a result, a knitted fabric exhibiting high heat generation when stretched is obtained. This structural difference between the conventional knitted fabric and the stretchable knitted fabric of the present invention can be made clear by the following method.

That is, the length obtained by adding the length of sinker loop of the elastic yarn and the length of needle loop of the non-elastic yarn in one unit of the knit structure when the knitted fabric is stretched by 30% in both warp and weft directions is assumed to be La. Furthermore, the length obtained by adding the length of sinker loop of the elastic yarn and the length of needle loop of the non-elastic yarn in one unit of the knit structure when the knitted fabric is further stretched by 50% in either one of warp and weft directions is assumed to be Lb. In order to obtain a knitted fabric exhibiting high heat generation when stretched, La and Lb preferably satisfy $1.2 \leq Lb/La \leq 1.8$. Lb/La can be adjusted to fall in this range by controlling the knit structure or the conditions in the dyeing step. When Lb/La is in the range above, the knitted fabric stretched generates heat without impairing the wearing feel. If Lb/La is less than 1.2, the percentage elongation of the elastic yarn in the knitted fabric is low and in turn, the heat generation temperature when stretched is as low as incapable of realizing the heat generation. Furthermore, the stretching and stretch-recovery of the elastic yarn are bad, making it impossible for the stretched knitted fabric to recover, and the knitted fabric is likely to wave and lose its shape. Also, if the ratio exceeds 1.8, the power of the elastic yarn becomes too high and not only the garment formed is difficult to wear or hinders smooth movement but also the knitted fabric is greatly deformed to cause too large deformation of the non-elastic yarn in conjunction with the elastic yarn, as a result, the stretch-recovery lacks and the knitted fabric stretched/relaxed may be waved or changed in the dimension due to washing, giving rise to losing the shape. Accordingly, La and Lb preferably satisfy $1.2 \leq Lb/La \leq 1.8$, more preferably satisfy $1.3 \leq Lb/La \leq 1.7$. By satisfying these conditions, a garment capable of generating heat by stretching and kept from losing its shape during wear as well as during washing can be formed.

In the present invention, La and Lb are determined from the length of sinker loop of the elastic yarn and the length of needle loop of the non-elastic yarn in one unit of the knit structure measured by the following method using an enlarged image photographed from the needle loop side (technical face) of the knitted fabric. Normally, the length of needle loop of the elastic yarn is also preferably measured, but the needle loop of the elastic yarn is often covered with the non-elastic yarn and the loop length can be hardly measured. Accordingly, a portion where the needle loop of the elastic yarn hidden under the needle loop of the non-elastic yarn can be confirmed to exist is selected and by measuring the length of needle loop of the non-elastic yarn that moves in the same motion as the elastic yarn during stretching, the value of change obtained is used as a substitute for the change in needle loop length of the elastic yarn due to stretching of the knitted fabric. Of course, a portion where the needle loop of the elastic yarn hidden under the non-elastic yarn is absent is not selected as the portion of which enlarged image is photographed.

The method for measuring each loop length is described below by using FIG. 1. The knitted fabric is stretched by 30% in both warp and weft directions and in this state, the needle loop side of the knitted fabric is observed in the enlarged manner. As shown in FIG. 1, two bottommost parts of an observable needle loop on both lower sides of the needle loop of the non-elastic yarn are designated as starting point 2 (circle) and ending point 3 (circle), respectively, and the loop length from starting point 2 to ending point 3 is measured and taken as the length of needle loop (1) of the non-elastic yarn. With respect to the sinker loop, as shown in FIG. 1, an elastic yarn between needle loop and needle loop observed in two wales is selected and by designating both ends of the elastic yarn as starting point 5 (circle) and ending point 6 (circle), the length therebetween is measured and taken as the length of sinker loop (4) of the elastic yarn.

For example, in the case of using a circular knitting or a covering yarn, when the elastic yarn is covered with the non-elastic yarn, the length of elastic yarn is measured by estimating the site where the elastic yarn is located. In this case, the length is measured assuming that the elastic yarn in the portion covered with the non-elastic yarn is linearly present. Also, when the sinker loop of the elastic yarn extends across two or more wales in the warp-knitted cord structure or circularly knitted welt structure, the sinker loop in the portion hidden in the needle loop existing in the middle of the sinker loop is not measured, but the length of only the sinker loop observed from the surface is measured, and the sum of sinker loop lengths in respective wales is taken as the length of the sinker loop (4).

For both of the elastic yarn and the non-elastic yarn, the length in the widthwise center part of a fiber bundle is measured. After respective measurements, the length of sinker loop (4) of the elastic yarn is added to the length of needle loop (1) of the non-elastic yarn, and the total of loop lengths in one unit of the knit structure is determined and designated as La. Subsequently, the knitted fabric is further stretched by 50% in the warp or weft direction, and the sum of loop lengths in one unit of the knit structure is determined in the same manner and designated as Lb. These measurements are performed for both the warp direction and the weft direction, and it may be sufficient if $1.2 \leq Lb/La \leq 1.8$ is established in either one direction of warp-direction stretching and weft-direction stretching. Incidentally, in the case of a knitted fabric stretchable only in one direction, the measurement is performed only for the stretchable direction, and the value obtained is taken as the loop length.

Incidentally, in the measurements of La and Lb, a length is determined to at least two decimal places as the length of each loop, and an average length when measured at arbitrary 10 portions is determined. Based on the average length, Lb/La is calculated and set to fall in 1.2≤Lb/La≤1.8 by rounding in the second decimal.

Also, one unit of the knit structure means one unit repeated in the structure composed of a needle loop and a sinker loop and, for example, in the warp-knitted denbigh structure, the sum of one loop length of needle loop and one loop length of sinker loop is one unit of the knit structure. Furthermore, in the case of circular knitting where knit and tuck are repeated in the wale direction, as for the needle loop, the sum of one loop of knit loop and one loop of tuck loop is one unit of needle loop, and the length obtained by adding two loops of sinker loop becomes La or Lb. Incidentally, in the case where the knit structure is welt (miss), the width of needle loop of the non-elastic yarn is taken as the needle loop length of the welt structure.

In general, when the knitted fabric is stretched by 50% in the warp direction, the needle loop is mainly stretched and the sinker loop is little stretched. On the other hand, when stretched by 50% in the weft direction, the sinker loop is mainly stretched and the needle loop is little stretched. Therefore, to heat generation during stretching, the needle loop greatly contributes at the stretching in the warp direction, and conversely, the sinker loop greatly contributes at the stretching in the weft direction. Taking note of only these loops, when only the amount of change in the needle loop at the measurements of La and Lb is extracted, the amount of change in the needle loop at the stretching by 50% in the warp direction is preferably from 1.2 to 1.7 times compared to before stretching, and the amount of change in the sinker loop at the stretching by 50% in the weft direction is preferably from 1.8 to 4.0 times compared to before stretching. Incidentally, in this case, the amount of change becomes larger than the amount of stretch of the knitted fabric, because although the sinker loop is naturally elongated by stretching, in the stretchable knitted fabric of the present invention, the needle loop portion is firmly fixed in many cases even when stretched, making it difficult for the needle loop portion to be stretched in the weft direction, and the sinker loop is elongated accordingly more than the amount of stretch of the knitted fabric, as a result, the amount of change in the sinker loop becomes larger than the amount of stretch of the knitted fabric.

In the stretchable knitted fabric of the present invention, the change ratio Lb/La of the loop length can be made to fall in 1.2≤Lb/La≤1.8 by reducing the curving or meandering of the elastic yarn by means of changing the knockover depth (stitch density) or the shape of sinker and adjusting the feed amount of yarn, and furthermore, by controlling the density particularly in the dyeing process. More specifically, the circularly knitted or warp-knitted (tricot) gray fabric greatly increases in the density during dyeing, and the density is generally increased by approximately from 1.3 to 1.8 times compared with that in the gray fabric state. This is done because the main object of the conventional knitted fabric containing an elastic yarn is to impart stretchability and by increasing the density to such an extent, a knitted fabric having good stretchability is obtained. On the other hand, the object of the stretchable knitted fabric of the present invention is to generate heat when stretched, and the elastic yarn in the knitted fabric must be efficiently stretched at the time of stretching the knitted fabric. Therefore, the knitted fabric after dyeing is preferably finished to have almost the same density as the gray fabric so that the elastic yarn in the dye-finished knitted yarn can be in the substantially straight state, and particularly at the presetting, the density may be controlled to become the same as that of the gray fabric.

In the stretchable knitted fabric of the present invention, the effect of power when the knitted fabric is further stretched is great, and the power of the knitted fabric in the stretched state corresponding to that during wear is preferably in a specific range. Specifically, the knitted fabric is stretched by about 30% during wear and from this stretched state, further stretched by about 50% by the action after wearing and therefore, the power of the knitted fabric stretched by 95% in at least one direction of warp and weft directions of the knitted fabric, as measured by the following method, is preferably from 2.5 to 8.0 N, more preferably from 2.5 to 7.0 N, still more preferably from 3.0 to 6.0 N.

The power of the knitted fabric stretched by 95% is measured by the following method:

(i) the knitted fabric in the state of being stretched by 30% of the initial length is set on a tensile tester and the stress value here is assumed to be 0 (zero) N, and (ii) the stress value (N) when further stretched by 50% based on the length at the setting above (stretched in total by 95% of the initial length of the knitted fabric) is measured and taken as the power of knitted fabric stretched by 95%.

If the power of the knitted fabric stretched by 95% is less than 2.5N, the knitted fabric may facilitate smooth movement but generates little heat when stretched, whereas if the power of the knitted fabric is too high, the wearer may be hindered from smooth movement. In particular, if the power exceeds 7.0 N, the stretchability is poor, and an uncomfortable garment giving a tight feeling during wear may be formed. Therefore, the power of the knitted fabric stretched by 95% in the direction in which stretch-heat generation occurs is preferably from 2.5 to 7.0 N. Incidentally, in both the warp and weft directions of the knitted fabric, the power of the knitted fabric stretched by 95% is preferably from 2.5 to 7.0 N, but it may be sufficient if the power of the knitted fabric stretched by 95% in either the warp or weft direction of the knitted fabric is from 2.5 to 7.0 N. In the case of a knitted fabric where the power differs between the warp direction and the weft direction, at the sewing to, for example, ankle-length leggings-style bottoms, when the sewing is performed by arranging the high power direction of the knitted fabric to become the direction in which the leg is inserted, the effects of the present invention are readily brought out. Incidentally, the measurement of power of the knitted fabric is performed by the method described in Examples.

In the stretchable knitted fabric of the present invention, the power may partially vary to allow for a mixed distribution of a high power part and a low power part in a dot, line, curve or other pattern by changing the knit structure or the yarn used or applying a resin print or the like. In this case, it may be sufficient if even a part of the knitted fabric satisfies the performance above. For example, in a knitted high-power fabric, when the power of the knitted fabric stretched by 95% is about 8 N and smooth movement is likely to be hindered during wear as a garment or the like, it is possible to design only the portion requiring the stretch-heat generation effect, such as knee, to have a high power and other portions to have a low-power texture that generates little heat but stretches well.

Incidentally, while a power when stretched by 95% is measured as the power of knitted fabric, the stretch-heat generation is measured at stretching by 100%, and this seems contradictory, but the reason why stretching by 100% is used for the measurement of stretch-heat generation is to enable making the effect of stretch-heat generation clearer.

As a result of more studies on heat generation of the stretchable knitted fabric of the present invention, it has been found that the heat generation is greatly affected by the stretch-heat generation index represented by the following formula. That is, when the stretch-heat generation index represented by the following formula is from 0.5 to 4.0, the knitted fabric of the present invention capable of successfully generating heat when stretched is obtained.

Stretch-heat generation index=(weight of elastic yarn×power of knitted fabric stretched by 95%)/elongation degree of knitted fabric The weight of elastic yarn is the weight (g/m$^2$) of elastic yarn per unit area of the knitted fabric, the power of knitted fabric stretched by 95% is the power (N) of knitted fabric as measured by the method above, the elongation degree of knitted fabric is the elongation degree (%) of knitted fabric under a load of 9.8 N/2.5 cm, and the stretch-heat generation index is calculated for each of warp and weft directions. The stretch-heat generation index in the warp direction is determined by using the power of knitted fabric and the elongation degree of knitted fabric in the warp direction, and the stretch-heat generation index in the weft direction is determined similarly by using the power of knitted fabric and the elongation degree of knitted fabric in the weft direction. Incidentally, in the case of being stretchable only in one direction, the stretch-heat generation index is determined only for the stretchable direction.

As the stretch-heat generation index is larger, the stretch-heat generation temperature rises, but if the stretch-heat generation index exceeds 4.0, the heat generation temperature may be high, but the garment is likely to hinder the movement during wear, whereas if the stretch-heat generation index is less than 0.5, a knitted fabric having a low stretch-heat generation temperature is formed. Accordingly, the design of knitted fabric and the dyeing process may be performed so that the stretch-heat generation index can be from 0.5 to 4.0, preferably from 0.7 to 3.8. Preferably, the stretch-heat generation index is from 0.5 to 4.0 in both the warp and weft direction of the knitted fabric, but it may be sufficient if the stretch heat generation index in either the warp or weft direction of the knitted fabric is from 0.5 to 4.0. Incidentally, the stretch-heat generation index in Examples of the present invention indicates the value in the direction where the stretch-heat generation temperature is higher.

The stretch-heat generation index can be adjusted to be from 0.5 to 4.0 by controlling respective parameters constituting the formula above. An increase in the stretch-heat generation index may be achieved by adjusting one condition or a plurality of conditions out of three conditions: (1) increasing the weight of elastic yarn, (2) increasing the power of knitted fabric and (3) decreasing the elongation degree of knitted fabric. The method for increasing the weight of elastic yarn includes, for example, a method using a thick elastic yarn; a method of increasing the density of knitted fabric by increasing the gauge of the knitting machine or decreasing the loop of elastic yarn; a method of densifying the knit structure of elastic yarn, for example, by using two needle stitch in the case of tricot or forming a structure with many swings such as cord structure; a method of organizing the structure by increasing the feed amount of elastic yarn (decreasing the draft ratio); and a method of increasing the density by applying a running-in process at the setting without stretching the knitted fabric during the dyeing process. Also, the method for increasing the power of knitted fabric includes a method of thickening the non-elastic yarn, and a method of increasing the number of loops in the knit structure, in addition to the above-mentioned methods for increasing the weight of elastic yarn. As for the knit structure, for example, in the case of circular knitting, it is preferred that a tuck loop, a welt (miss) loop or an insertion structure is arranged in the knitted fabric, a larger number of such loops leads to a higher power of the knitted fabric, and the ratio of the knit loop in the knitted fabric is from 30 to 70%. In the case of warp knitting, the power of knitted fabric can be increased by chain, denbigh or insertion structure, and in all cases, a less stretchable structure is effective. Also, in order to increase the power of knitted fabric, for example, a method of finishing the fabric slightly at a coarse density during the dyeing process may be performed. The elongation degree of the knitted fabric can be decreased by the same method as the method for increasing the power of the knitted fabric. A stretch-heat generation index of 0.5 to 4.0 may be easily achieved by increasing the weight of elastic yarn, increasing the power of knitted fabric, or decreasing the elongation degree of knitted fabric, but all of these factors are closely related and therefore, when the knitted fabric is appropriately designed to have a stretch-heat generation index of 0.5 to 4.0, a knitted fabric capable of effectively causing stretch-heat generation is obtained.

Furthermore, in the stretchable knitted fabric of the present invention, the power of elastic yarn stretched by 100% in the knitted fabric as measured by the later-described method is preferably from 0.04 to 0.20 cN (centi-Newton=N×0.01)/dtex. The power of elastic yarn greatly governs the stretch-heat generation, and if the power of elastic yarn is less than 0.04 cN/dtex, sufficient stretch-heat generation is not obtained, whereas if the power of elastic yarn exceeds 0.20 cN/dtex, the knitted fabric becomes hard to stretch and when sewn to a garment, the wearer is disadvantageously hindered from smooth movement. Accordingly, the power of elastic yarn is from 0.04 to 0.20 cN/dtex, preferably from 0.05 to 0.18 cN/dtex, more preferably from 0.10 to 0.17 cN/dtex.

In measuring the power of elastic yarn, the elastic yarn in the knitted fabric is withdrawn, and the numerical value obtained by measuring the power when stretched to 100% by a Tensilon tensile tester and dividing it by the fineness is taken as the power of elastic power, but the withdrawn elastic yarn is sometimes crimped and in this case, the elastic yarn is stretched by the Tensilon tensile tester, and the power of elastic yarn is measured by stretching the yarn by 100% from the starting position where the load becomes 0 (zero). Also, for withdrawing the elastic yarn, a method of unraveling the knitted fabric and withdrawing the elastic yarn, a method of cutting the non-elastic yarn and withdrawing the elastic yarn from the knitted fabric, or a method of melting the non-elastic yarn to leave only the elastic yarn and withdrawing the elastic yarn may be performed, and after withdrawing the elastic yarn by using these methods individually or in combination, the power of elastic power is measured. Incidentally, as for the fineness of elastic yarn, the withdrawn elastic yarn is straightened by stretching the crimp and stretched by a tensile tester and after measuring 10 elastic yarns for the length and weight when the load becomes 0 (zero), the average value thereof is taken as the fineness. Furthermore, in the case where the elastic yarn cannot be withdrawn from the knitted fabric because of, for example, fusion of elastic yarns each other, only the elastic yarn of 1 wale or 1 course of the knitted fabric is cut; needle loops continuously connected in the course direction or wale direction are taken as one fiber (referred to as loop fiber); in this state, the fineness of the loop fiber (referred to as loop fineness) is determined from the length and weight; and the power of this loop fiber when 100% stretched is measured and used as a substitute for the power of elastic yarn. However, since a power rise occurs due to interlacing of loops, the value obtained by correcting the measured power according to the following formula is taken as the power of elastic yarn.

Power of elastic yarn incapable of being withdrawn= (power of elastic yarn in terms of loop fiber of 1 wale (1 course))×0.8/loop fineness As for the loop fineness of elastic yarn here, the loop fiber of elastic yarn withdrawn is straightened by stretching the crimp and stretched by a tensile tester and after measuring 10 loop fibers for the length and weight when the load becomes 0 (zero), the average value thereof is taken as the loop fineness.

The elastic yarn for use in the stretchable knitted fabric of the present invention includes a polyurethane-based elastic yarn and a polyether ester-based elastic yarn, and as the elastic yarn having the above-described power, a polyurethane elastic yarn is preferred. Among others, a polyurethane urea elastic yarn having a soft segment composed of a urethane structure and a hard segment composed of a urea structure is preferred.

In order to obtain a high-power elastic yarn in the knitted fabric, a method of increasing the molecular weight of the elastic yarn may be used. Other methods include, for example, a method of adding a urethane urea compound having an average number of urea bonding units of 4 to 40 per molecule, which is obtained by reacting a nitrogen-containing compound containing at least one member selected from a monofunctional amine of either primary amine or secondary amine, a hydroxyl group, and tertiary nitrogen or heterocyclic nitrogen, with an organic diisocyanate, described in Japanese Unexamined Patent Publication No. 2001-140127; a urea compound obtained by reacting a nitrogen-containing compound containing at least one bifunctional amine group selected from a primary amine and a secondary amine and containing at least one nitrogen-containing group selected from a tertiary nitrogen and a heterocyclic nitrogen, with at least one compound selected from the group consisting of an organic diisocyanate, a mono- or di-alkylmonoamine, an alkylmonoalcohol and an organic monoisocyanate, described in Japanese Patent No. 4,343,446; or a polyacrylonitrile-based polymer, a hydroxyl group-terminated polyurethane obtained by reacting a mixture of a low molecular diol and a polymer diol with an organic diisocyanate, or a styrene-maleic anhydride copolymer, described in Japanese Unexamined Patent Publication No. 7-316922; when spinning the elastic yarn. The above-described hydroxyl group-terminated polyurethane is preferably a polyurethane polymer having a number average molecular weight of 10,000 to 40,000, which is a reaction product of a mixture of a low molecular diol having a hydroxyl group at both terminals of a linear or branched alkylene group having from 2 to 10 carbon atoms or a divalent alicyclic hydrocarbon, and a polymer diol having a number average molecular weight of 400 to 3,000 (molar ratio: from 1 to 99), with an organic diisocyanate and in which the terminal is a hydroxyl group and the urethane group concentration is 3 milli-equivalent/g or more. The elastic yarn with high power may be obtained by adding one of these compounds alone or adding a mixture of two or more thereof, to the elastic yarn, but if the amount added is small, the stretch-heat generation temperature effect is low, whereas if the amount added is large, the stretch recovery is reduced and the shape loss readily occurs during wear and washing. Therefore, the amount added is from 2.0 to 15.0%, preferably from 2.5 to 8.0%, based on the weight of the elastic yarn.

The power of elastic yarn may be adjusted by the methods above to become from 0.04 to 0.2 cN when 100% stretched.

Heat generation of the stretchable knitted fabric of the present invention when stretched is also greatly affected by the elongation degree of knitted fabric. That is, the elongation degree of knitted fabric in the direction causing stretch-heat generation under a load of 9.8 N is preferably from 70 to 200%, more preferably from 80 to 180%. If the elongation degree is less than 70%, movement during wear is inhibited and a garment hindering smooth movement is formed. Also, if the elongation degree exceeds 200%, the knitted fabric producing a low heat-generation effect when stretched is obtained. Furthermore, the sum of warp and weft elongation degrees of the knitted fabric is also important to stretch-heat generation and easy movement during wear, the sum of warp and weft elongation degrees of the knitted fabric under a load of 9.8 N is preferably from 170 to 450%. If the sum is less than 170%, the stretchability is poor, and an uncomfortable garment giving a tight feeling during wear may be formed, whereas if the sum exceeds 450%, smooth movement during wear may not be hindered, but a knitted fabric incapable of sufficiently generating heat is obtained. The sum is more preferably from 180 to 400° C. Incidentally, in the knitted fabric, a high elongation degree part and a low elongation degree part partially differing in the elongation degree may be mixed in a dot, line, curve or other pattern by changing the knit structure or the yarn used or applying a resin print or the like, and it may be sufficient if even a part of the knitted fabric satisfies the performance above.

The elongation degree of the knitted fabric can be adjusted by controlling the gauge of knitting machine, the structure of knitted fabric or the density or controlling the finenesses of non-elastic yarn and elastic yarn. Incidentally, in producing a garment, although not particularly limited, when the garment is produced by conforming the direction of low elongation degree of the knitted fabric to the direction in which the garment is often stretched during wear, a garment readily exerting the stretch-heat generation effect is obtained.

Furthermore, in the stretchable knitted fabric of the present invention, the elongation degree ratio between the warp direction and the weft direction under a load of 9.8 N is preferably from 0.6 to 2.5, and when the stretchable knitted fabric having this elongation degree ratio is sewn to a garment, an appropriately unloose feel is given, and bending and stretching of the body are facilitated. If the elongation degree ratio is less than 0.6, when the body is bent or stretched, the wearer feels tight and an uncomfortable garment is obtained. If the elongation degree ratio exceeds 2.5, wrinkles may be generated when the body is bend or stretched, and slacking may disadvantageously occur in the knitted fabric. Accordingly, the elongation degree ratio between the warp direction and the weft direction of the knitted fabric is preferably from 0.6 to 2.5, more preferably from 0.8 to 2.3. Incidentally, the elongation degree ratio as used in the present invention is determined according to the following formula by measuring the elongation degree in both the warp direction and the weft direction.

Elongation degree ratio=(elongation degree in warp direction)/(elongation degree in weft direction)

In the stretchable knitted fabric of the present invention, the stretch recovery ratio of the knitted fabric is also important, and a knitted fabric having a stretch recovery ratio of 85% or more in both the warp direction and the weft direction is preferred. If the stretch recovery ratio is less than 85%, a reduction in the amount of heat generation when repeating stretching/shrinking may be disadvantageously incurred. Incidentally, the methods for measuring the elongation degree and stretch recovery ratio of the knitted fabric are specifically described in Examples.

Also, in the stretchable knitted fabric of the present invention, when at least a part of the elastic yarn is organized in a looping structure, high heat generation occurs when the knitted fabric is stretched, and the object of the present invention is successively achieved. That is, in the warp knitting, the loop texture of the elastic yarn fed to at least one reed preferably has a looping structure and also when the elastic yarn is used for a plurality of reeds, at least one reed preferably forms a looping structure.

The looping structure of the elastic yarn for use in the present invention includes, for example, a structure formed by changing the swing amount of the sinker loop, such as chain (10/01), denbigh (10/12), cord (10/23, 10/34) and satin (10/45, 10/56), a changing pattern such as Atlas (e.g., 10/12/23/34/32/21, 10/23/45/67/54/32), and a two needle stitch feeding the elastic yarn to two needles at the overlapping (e.g., 20/13, 20/24), and not only a closed loop structure but also an open loop structure or a mixture thereof may be used.

Furthermore, in order to more successfully bring out the stretch-heat generation effect, two or more needle swing such as 10/23 and 10/34, or two needle stitch such as 20/13 and 20/24 is preferably used for the swing of the elastic yarn. Also, the yarn arrangement of elastic yarn is not particularly limited, and an arbitrary yarn arrangement such as all-in arrangement in which the elastic yarn is passed through all needles, and one-in one-out arrangement in which the elastic yarn is passed through every other reed, may be used, but the method of organizing the elastic yarn by passing it through all reeds (all-in) is preferred, because the content of elastic yarn is easily increased and a dense knitted fabric capable of uniformly generating heat is obtained. Also, when a knitting machine with 32 gauge or more is used so as to densify the knitted fabric and reduce the meandering or curving of the elastic yarn in the knitted fabric and the knitted fabric is finished to have almost the same density as the gray fabric, a garment exhibiting good stretch-heat generation and giving an excellent wearing feel is advantageously produced.

The stretchable knitted fabric of the present invention can be produced also by a circular knitting machine, and also in the circular knitting, at least a part of the organized structure is preferably a looping structure. However, in the case of circular knitting, the heat generation effect during stretching is small and therefore, the ratio of the knit loop in the loops made of the elastic yarn in the knitted fabric is set to be from 30 to 70%, whereby the heat generation effect during stretching can be elevated. If the ratio is less than 30%, the elongation degree of knitted fabric is insufficient and easy movement during wear is hindered, whereas if the ratio exceeds 70%, the knitted fabric may have a high elongation degree but the heat generation effect is insufficient. When the ratio of the knit loop in the knitted fabric is from 30 to 70%, a knitted fabric more kept from inhibiting movement than forming all loops by the knit loop is obtained. As for the loop other than the knit loop in the knitted fabric, either a tuck loop or a welt loop (miss loop) or a combination of both loops may be selected. If the loop of elastic yarn is composed by only the knit loop, in the case of circular knitting, when the knitted fabric is stretched, a great deformation of loop occurs and the elastic yarn is little stretched, as a result, the stretch-heat generation effect cannot be sufficiently exerted. By combining a tuck loop or a welt loop in the knitted fabric, the elastic yarn is effectively stretched during stretching of the knitted fabric and the heat generation effect is increased. Incidentally, the ratio of the knit loop in the knitted fabric is calculated from the number of loops for each of the knit loop, the tuck loop and the welt loop in one complete structure of the knit structure. Of course, a portion consisting of only a knit loop and a portion where a tuck loop or a welt loop is incorporated and the ratio of the knit loop is from 30 to 70%, may be mixed in a patterned manner. In this case, only the portion where the ratio of the knit loop is from 30 to 70% experiences stretch-heat generation and therefore, this portion may be disposed in the extension/contraction region such as knee and elbow.

Also, it is preferred that the elastic yarns are fixed each other at the intersecting part of elastic yarns, for example, the elastic yarn in the knitted fabric is partially melted in the intersecting portion, thereby fusing and fixing the elastic yarns each other, or the intersecting portion of elastic yarns is deformed, thereby engaging and fixing the elastic yarns each other, and as long as the elastic yarns are in such a state, the heat generation effect during stretching is increased. Incidentally, the intersecting portion of elastic yarns includes a portion where needle loops are intersected each other, a portion where a needle loop and a sinker loop are intersected, and a portion where sinker loops are intersected each other, and elastic yarns involved in any of these intersections are fixed each other.

As for the method to fix elastic yarns each other at the intersecting part, fixing by heat is simple and easy and at the heat setting using a pin tenter or the like in the dyeing process, when the knitted fabric is passed at a high temperature of 185° C. or more, elastic yarns are readily fixed. In the case where the fixing is insufficient, this may be overcome by lengthening the heat setting time or raising the heat setting temperature in the range not exceeding 200° C. If heating is performed at a heat setting temperature of 200° C. or more for 30 seconds, there is a risk of embrittling or yellowing both the elastic yarn and the non-elastic yarn. In addition, the elastic yarns can be fixed each other also by a method of using an elastic yarn capable of exhibiting a high setting effect even in steam setting at about 100° C. or heat setting at about 180° C. and causing fixing of elastic yarns each other.

In order to determine the fixed state of the intersecting part of elastic yarns each other, in the case of warp knitted fabric, after melting the non-elastic yarn in the knitted fabric to leave only the elastic yarn in the knitted fabric, whether the intersecting part is fixed or not can be determined by means of a microscope. In the case where the intersecting part of elastic yarns each other is lightly stretched and not easily separated or where slippage of a needle loop and sinker loop does not occur, the intersecting part can be judged as being fixed. When the non-elastic yarn of the knitted fabric cannot be melted, the non-elastic yarn in the knitted fabric is removed by cutting under observation by a microscope to leave only the elastic yarn, whereby whether the intersecting part of elastic yarns each other is fixed or not can be determined. Incidentally, even in a knitted fabric where the intersecting part of elastic yarns each other is fixed, intersecting parts of all loops in the knitted fabric need not be fixed, and it may be sufficient if 60% or more of the knitted fabric area is fixed. Also, in the case of circular knitted fabric, the elastic yarn is unraveled and withdrawn together with the non-elastic yarn from the knit-up direction of the knitted fabric and when the elastic yarn can be withdrawn 10 cm or more, the intersecting part can be judged as not being fixed.

As for the elastic yarn for use in the stretchable knitted fabric of the present invention, polyurethane-based and polyether ester-based elastic yarns, for example, a polyurethane-based elastic yarn that is dry spun or melt spun, can be used, and the polymer and the spinning method are not particularly limited. The elastic yarn preferably has an elongation at break of approximately from 400 to 1,000% and is excellent in the stretchability and kept from deterioration of the stretchability at around 180° C. that is a normal treating temperature in the preset step of the dyeing process. In addition, an elastic yarn obtained by adding a special polymer or powder to the elastic yarn to impart functionality such as high settability, antibacterial activity, moisture absorbency and water absorbability, may also be used. As for the fineness of elastic yarn, a fiber of approximately from 10 to 160 dtex may be used, and an elastic fiber of approximately from 20 to 80 dtex, which facilitates the production of knitted fabric, is preferably used. In addition, for example, a covering yarn obtained by winding a non-elastic yarn around an elastic yarn, a twisted yarn, a blended yarn obtained by mixing a non-elastic yarn and an elastic yarn by air injection or the like can also be used.

Furthermore, in the stretchable knitted fabric of the present invention, an inorganic substance can be incorporated into the elastic yarn, and a knitted fabric coupled with the performance of the inorganic substance incorporated can be obtained. For example, when titanium oxide is incorporated, heat generated by the knitted fabric is stored in the titanium oxide, and warmth retaining property by a far infrared effect can be imparted. As for the method to incorporate an inorganic substance, a method of incorporating an inorganic substance into a spinning stock solution for the elastic yarn and spinning the solution can most facilitate the incorporation. The inorganic substance as used in the present invention is an inorganic material alone and/or an inorganic compound, such as ceramic of titanium oxide or the like, carbon and carbon black, and a fine powder is preferred so as not to disturb the spinning of the elastic yarn. Such an inorganic substance is preferably incorporated in an amount of 1 to 10 wt % into the elastic yarn, and by virtue of containing an inorganic substance, the warmth retaining effect during heat generation of the knitted fabric can be more effectively brought out. Incidentally, if the content of the inorganic substance is small, the warmth retaining effect is low, whereas if the content is too large, yarn breakage may occur during spinning or stretching. Therefore, the content is preferably from 1 to 10 wt %, more preferably from 2 to 5 wt %.

As the non-elastic yarn for use in the present invention, all fibers, for example, a polyester-based fiber such as polyethylene terephthalate and polytrimethylene terephthalate, a polyamide-based fiber, a polyolefin-based fiber such as polypropylene, a cellulose-based fiber such as cupra, rayon, cotton, bamboo fiber, and an animal hair fiber such as wool, can be used. Also, a bright yarn, a semi-dull yarn, a fully dull yarn and the like of these fibers can be arbitrarily used, and as for the cross-sectional shape of the fiber, a fiber having an arbitrary cross-sectional shape such as round, oval, W-shape, cocoon and hollow yarn, may be used. The form of the fiber is also not particularly limited, and an original yarn and a yarn subjected to a crimping treatment such as twisting can be used. Furthermore, a long fiber or a spun yarn may be used, and a composite yarn obtained by twisting two or more kinds of fibers or mixing the fibers by covering, air injection or the like, can also be used. In addition, not the mixing of fibers themselves, but mixing of two or more kinds of fibers on a knitting machine may also be possible and, for example, in the case of a warp knitting machine, the knit structure may be organized by preparing reeds corresponding to two or more kinds of fibers, respectively. As for the thickness of the fiber, a fiber of approximately from 15 to 160 dtex may be used and in view of bursting strength or thick feel of the knitted fabric, a fiber of approximately from 20 to 110 dtex is preferably used. Incidentally, in using cotton or wool, the thickness of the fiber used can be determined by a conversion formula for each fiber.

The non-elastic yarn for use in the present invention preferably contains from 0.3 to 5 wt % of an inorganic substance and, among others, a polyester-based fiber, a polyamide-based fiber and a cellulose-based fiber each preferably contains an inorganic substance. By containing an inorganic substance, the warmth retaining effect can be more effectively exerted during heat generation of the elastic knitted fabric. Incidentally, if the content of the inorganic substance is small, the warmth retaining effect is low, whereas if the content is too large, yarn breakage may occur during spinning or stretching. Therefore, the content is more preferably from 0.5 to 5 wt %, still more preferably from 0.4 to 3 wt %.

In the stretchable knitted fabric of the present invention, when a hygroscopically heat-generating material such as cellulose is used for the non-elastic yarn, heat is generated by absorbing moisture during wear and heat is also generated by doing exercise, so that the effects of the present invention can be more successfully brought out. Furthermore, the warmth retaining effect can also be elevated by using a spun yarn or raising the fabric and thereby hardly allowing the heat generated to escape.

The stretchable knitted fabric of the present invention can be produced by a tricot/raschel warp knitting machine or a circular knitting machine such as circular knitting machine having a cylinder size of approximately from 24 to 38 inch, small circular knitting machine of approximately from 8 to 20 inch, pantyhose knitting machine of about 4 inch and sock knitting machine, and both a single knitting machine and a double knitting machine can be used. As for the gauge of these knitting machines, a knitting machine having an arbitrary gauge can be used, but a knitting machine having a gauge of approximately from 24 to 40 is preferably used. If the gauge is coarse, the stretch-heat generation temperature is low and furthermore, aesthetics of the knitted fabric is also bad. Therefore, a knitting machine having as a high gauge as possible is preferably used, but as the gauge is higher, the stretchability is reduced and the garment formed is difficult to wear, requiring the stitch density or the like to be adjusted.

As for the method for dyeing and finishing of the stretchable knitted fabric of the present invention, a conventional dyeing/finishing process can be used, and dyeing conditions according to the fiber material used are selected. The dyeing machine used may also be arbitrary and, for example, may be a liquid flow dyeing machine, a wince dyeing machine or a paddle dyeing machine, and a processing agent for enhancing water absorbability or flexibility or a processing agent for increasing the warmth retention may be also used.

When the stretchable knitted fabric of the present invention is sewn to a garment covering the joint region where the knitted fabric is stretched during wear or action, specifically, sportswear or innerwear bottoms such as spats, sports tights, compression tights and girdle, tops such as underwear, shirt and compression shirt, legs such as pantyhose, socks, tights and leggings, supporters such as elbow supporter, knee supporter, waist supporter, ankle cover, arm cover, leg cover, knee cover and elbow cover, and gloves, a garment capable of keeping the wearer warm by the daily activity or athletic motion is formed.

In particular, for the compression wear, that is, for example, shirts with sleeve such as long sleeve or half sleeve and above-knee-, below-knee- or ankle-length spats, which are worn in close contact with skin mainly when doing exercise such as jogging, various games and walking, a knitted fabric that is composed of a warp knitted fabric having a basis weight of approximately from 150 to 300 g/m$^2$ and contains from 40 to 80 g/m$^2$ of elastic yarn and where the sum of warp and weft elongation degrees of the knitted fabric is from 170 to 300% under a load of 9.8 N, the structure of elastic yarn of at least one reed is organized in a looping structure, and the elastic yarns are fixed each other at the intersecting part of elastic yarns, is suited, and when this knitted fabric is used in the joint region such as elbow, knee, crotch or ankle, a particularly high heat generation effect is obtained. Such wear is preferably sewn such that the knitted fabric is used at least in those joint regions.

Also, for example, even in the case of thin leg clothing such as tights, leggings and socks produced by a circular knitting machine or bottom clothing produced by a circular knitting machine such as circular knitting machine having a cylinder size of approximately from 24 to 38 inch, small circular knitting machine having a cylinder size of approximately from 8 to 20 inch, pantyhose knitting machine of about 10 inch and sock knitting machine, the stretchable knitted fabric of the present invention gives clothing capable of keeping the wearer warm by the daily activity or athletic motion. Furthermore, the knitted fabric where the fineness of non-elastic yarn is from 15 to 60 dtex, elastic yarn is contained from 40 to 60 g/m$^2$, the sum of the warp and weft elongation degrees of the knitted fabric is from 170 to 300% under a load of 9.8 N, the elastic yarns are fixed each other at the intersecting part of elastic yarns, and the ratio of the knit loop in loops of the knitted fabric is from 30 to 70%, exhibits excellent warmth retention and exerts an effect of preventing an injury by warming the muscle or joint in the extension region, as bottom clothing.

EXAMPLES

The present invention is described in greater detail below by referring to Examples, but the present invention is not limited only to these Examples. The evaluations in Examples were performed by the following methods.

(1) Sampling

The place measured is basically random, and the measurement is performed at several portions, but in a knitted fabric partially varying in the fabric performance due to the knit structure, the yarn used, the presence or absence of resin print, and the like, when the portion satisfying the performance of the present invention cannot be confirmed, a portion that is highly likely to express the performance of the present invention can be preferentiaily measured. For example, in the case where a low power part (high elongation degree part) and a high power part (low elongation degree part) are mixed, the sampling is preferably performed such that the ratio of the high power part (low elongation degree part) becomes high, and the sampling may be performed to allow for respective measurements of the warp direction and the weft direction.

In the knitted fabric where the knit structure, the yarn used, the presence or absence of resin print, and the like are uniform, the sampling may be performed at random portions, and the sampling may be performed to allow for respective measurements of the warp direction and the weft direction.

(2) Instantaneous Heat Generation Temperature

In the measurement of instantaneous heat generation temperature, the following repeat stretching/shrinking tester is used, the surface temperature of the sample is measured and determined in the course of repeating the stretching and relaxing (returning) the specified number of times at the specified rate, the instantaneous heat generation temperatures in the warp direction and the weft direction of the knitted fabric are measured, and the higher temperature is taken as the instantaneous heat generation temperature.

Repeat stretching/shrinking machine: De Mattie tester (manufactured by Daiei Kagaku Seiki Mfg. Co., Ltd.)

Size of sample: length: 100 mm (excluding the gripping part), width: 60 mm

Measurement environment: Constant-temperature constant-humidity conditions at a temperature of 20° C. and a humidity of 65% RH; measured in the state of receiving no energy supply from the outside except for stretching/shrinking.

Stretch amount: 100% in the lengthwise direction

Repeat stretching/shrinking cycle: one time/sec

Measurement of heat generation temperature: The surface temperature of the sample is continuously measured by a thermography during repeat stretching/shrinking 100 times and after the completion of stretching/shrinking; the emissivity of the thermography is set to 1.0.

Evaluation of heat generation temperature: The temperature when the sample surface measured becomes the maximum temperature is read and by comparing it with the temperature before stretching/shrinking, the temperature rise is taken as the instantaneous heat generation temperature.

(3) Content of Elastic Yarn

The content (g/m$^2$) of elastic yarn in the knitted fabric is determined by the following method, and the first decimal is rounded off.

The non-elastic yarn in the knitted fabric is removed by melting or the like, and the weight of only the elastic yarn is measured and converted to the weight per unit area. When removal of the non-elastic yarn is difficult, the elastic yarn is removed by melting or the like from the knitted fabric after measuring the weight, and by measuring the weight of only the non-elastic yarn, the decrement weight is taken as the weight of elastic yarn.

(4) Fixing of Elastic Yarns Each Other

Whether the elastic yarns are fixed each other in the intersecting part is judged as follows.

In the case of warp knitting, the fixed state of the intersecting part of elastic yarns each other is observed by a microscope, and the intersecting part of elastic yarns each other is lightly stretched with tweezers or the like. When the intersecting part is not easily separated or when slippage of a needle loop and sinker loop does not occur, the intersecting part can be judged as being fixed, and by judging at 50 portions in total, the result is evaluated according to the following criteria. Ranks A and B were rated as passed.

A: 80% or more of intersecting parts were fixed.

B: From 60% to less than 80% of intersecting parts were fixed.

C: Intersecting parts fixed were less than 60%.

In the case of circular knitted fabric, the elastic yarn is unraveled and withdrawn together with the non-elastic yarn from the knit-up direction and whether the intersecting part of elastic yarns each other is fixed or not is evaluated according to the following criteria. Ranks A and B were rated as passed. Incidentally, as for the length of the elastic yarn withdrawn, the fineness of the withdrawn elastic yarn is measured, the length is measured by applying a load of 1/100 of the fineness, and the average value of 10 elastic yarns is taken as the length of the elastic yarn can be withdrawn.

C: The elastic yarn can be continuously withdrawn in a length of 20 cm or more

B: The elastic yarn can be continuously withdrawn in a length of 10 cm to less than 20 cm.

A: The elastic yarn can be continuously withdrawn only in a length of less than 10 cm.

(5) Power of Knitted Fabric

The powers in the warp and weft directions of the knitted fabric are measured by the following method, and the higher power is taken as the power of the knitted fabric.

Size of sample: length: 100 mm (excluding the gripping part), width: 25 mm

Tensile tester: Tensilon tensile tester (RTC-1210A, manufactured by Orientec Co., Ltd.)

Initial load: 0.1 N

Tensile speed: 300 mm/min

Tensile length: The knitted fabric is set to 30% stretch and further stretched by 50% based on the length after the stretching.

Measurement: The power (N) when stretched under the conditions above is determined.

(6) Power of Elastic Yarn Stretched by 100%

The power of the elastic yarn in the knitted fabric is measured by the following method.

Size of sample: length: 100 mm (excluding the gripping part)

Tensile tester: Tensilon tensile tester (RTC-1210A, manufactured by Orientec Co., Ltd.)

Tensile speed: 300 mm/min

Tensile length: The elastic yarn is stretched to 120%.

Measurement: The power (N) when stretched by 100% is determined based on the position where the load on the elastic yarn under the conditions above becomes 0 (zero); incidentally, in the case where the elastic yarn cannot be withdrawn and is measured in the state of loop fiber, the power is calculated by the above-described conversion formula.

(7) Elongation Degree of Knitted Fabric and Sum of Warp and Weft Elongation Degrees of Knitted Fabric The elongation degree of the knitted fabric is measured by the following method.

Size of sample: length: 100 mm (excluding the gripping part), width: 25 mm

Tensile tester: Tensilon tensile tester (RTC-1210A, manufactured by Orientec Co., Ltd.)

Initial load: 0.1 N

Tensile speed: 300 mm/min

Tensile length: Stretched to a load of 9.8 N.

Measurement: The knitted fabric is stretched under the conditions above, the elongation degree in each of the warp direction and the weft direction under a load of 9.8 N is determined, the elongation degree in the direction causing stretch-heat generation is taken as the elongation degree of knitted fabric, and the sum of warp elongation degree and the weft elongation degree is taken as the sum of warp and weft elongation degrees of knitted fabric.

(8) Stretch Recovery Ratio

The stretch recovery ratio is measured by the following method.

Size of sample: length: 100 mm (excluding the gripping part), width: 25 mm

Tensile tester: Tensilon tensile tester (RTC-1210A, manufactured by Orientec Co., Ltd.)

Initial load: 0.1 N

Tensile speed: 300 mm/min

Tensile length: 80 mm (80% stretch)

Number of pullings: Stretching/shrinking is repeated three times.

Measurement: The stretch recovery ratio at the third repeat stretching/shrinking of the knitted fabric under the conditions above is determined according to the following formula:

$$\text{Stretch recovery ratio}(\%)=[(180-a)/80]\times 100$$

a: the sample length when the stress at the third repeat stretching becomes 0 (100 mm+residual strain).

Example 1

Using a tricot warp knitting machine with 32 gauge, an elastic yarn of 44 dtex (Roica CR, trade name, produced by Asahi Kasei Fibers Corporation) and a nylon original yarn of 22 dtex/7f were prepared for the back reed and the front reed, respectively, and a knitted fiber was organized according the following structures and conditions.

Front reed: 10/23

Back reed: 23/10

The knitted fabric organized was relaxed and scoured by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed at 170° C. for 1 minute with the same density as that in the presetting to obtain a knitted fabric.

The knitted fabric obtained had a special structure, where the mixed ratio of the elastic yarn was 44% and higher than that of the normal tricot knitted fabric and where the content of elastic yarn and the power of knitted fabric were high and the elongation degree of knitted fabric was low. The performances of this knitted fabric were evaluated, and the results are shown in Table 1. The knitted fabric of the present invention exhibited an instantaneous heat generation temperature of 1.0° C. or more when stretched and thus was the target knitted fabric, and the ratio of dimensional change due to washing was −1.9% in warp and −2.5% in weft, revealing that this was a product that did not lose shape even when worn or washed as a garment.

Examples 2 to 5 and Comparative Example 1

Knitted fabrics were produced in the same manner as in Example 1 except for changing the fineness of elastic yarn to 33 dtex (Roica SF, trade name, produced by Asahi Kasei Fibers Corporation) (Example 2); changing the fineness of elastic yarn to 33 dtex and changing the structure of back reed to 20/1.3 (Example 3); and changing the fineness of elastic yarn to 22 dtex (Roica SF, trade name, produced by Asahi Kasei Fibers Corporation) and changing the structure of back reed to 12/10 (Comparative Example 1), and evaluations were performed. The results are shown in Table 1.

Also, a polyurethane polymer (agent A) used in Example 4 of Japanese Unexamined Patent Publication No. 7-316922 and a urethane urea compound (agent B) used in Example 1 of Japanese Unexamined Patent Publication No. 2001-140127 were prepared, and knitted fabrics were produced in the same manner as in Example 1 except for producing elastic yarns differing in the power by adding 7 wt % of agent A and 3 wt % of agent B (Example 4) or adding 3 wt % of agent A and 3 wt % of agent B (Example 5), to the spinning bath at the production of the elastic yarn of 44 dtex (Roica CR, trade name, produced by Asahi Kasei Fibers Corporation) and using these elastic yarns, and evaluations were performed. The results are shown in Table 1.

The ratio of dimensional change due to washing of the knitted fabrics of Examples 2 to 5 was from −0.6 to 1.3% in warp and from −0.7 to 1.9% in weft, revealing that these were products that did not lose shape even when worn or washed as a garment. On the other hand, in the garment according to Comparative Example, the ratio of dimensional change due to washing was −3.2% in warp and −4.2% in weft and thus, this was a product that readily lost shape due to wearing or washing.

Example 6

Using a tricot warp knitting machine with 32 gauge, an elastic yarn of 33 dtex (Roica SF, trade name, produced by Asahi Kasei Fibers Corporation), an elastic yarn of 33 dtex (Roica SF, trade name, produced by Asahi Kasei Fibers Corporation) and a nylon original yarn of 33 dtex/34f were prepared for the back reed, the middle reed and the front reed, respectively, and a knitted fiber was organized according the following structures.

Front reed: 10/23

Middle reed: 10/01

Back reed: 10/23

The knitted fabric organized was relaxed and scoured 1.5 by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed under the conditions of 170° C. and 1 minute to obtain a knitted fabric.

The performances of the knitted fabric obtained were evaluated, and the results are shown in Table 1. The knitted fabric of the present invention exhibited an instantaneous heat generation temperature of 1.0° C. or more when stretched and thus was the target knitted fabric, and the ratio of dimensional change due to washing was −0.3% in warp and −0.4% in weft, revealing that this was a product that did not lose shape even when worn or washed as a garment.

Example 7

Using a raschel warp knitting machine with 28 gauge (inch), an elastic yarn of 33 dtex (Roica SF, trade name, produced by Asahi. Kasei Fibers Corporation), an elastic yarn of 78 dtex (Roica SF, trade name, produced by Asahi Kasei Fibers Corporation) and a nylon original yarn of 44 dtez/34f were prepared for the back reed, the middle reed and the front reed, respectively, and a knitted fiber was organized according the following structures (shown by organization codes for tricot).

Front reed: 23/21/12/10/12/21

Middle reed: 00/11/00/11/00/11

Back reed: 10/12

The knitted fabric organized was relaxed and scoured by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed under the conditions of 170° C. and 1 minute to obtain a knitted fabric. The performances of the knitted fabric obtained were evaluated, and the results are shown in Table 1. The knitted fabric of the present invention exhibited an instantaneous heat generation temperature of 1.0° C. or more when stretched and thus was the target knitted fabric, and the ratio of dimensional change due to washing was −1.1% in warp and −2.4% in weft, revealing that this was a product that did not lose shape even when worn or washed as a garment.

Example 8

Using a single circular knitting machine with 32 gauge, an elastic yarn of 44 dtex (Roica SF, trade name, produced by Asahi Kasei Fibers Corporation) and a nylon textured yarn of 33 dtex/24f were prepared, and these yarns were organized in a tuck stitch structure of repeating a knit loop and a tuck loop by plating knitting.

The knitted fabric organized was relaxed and scoured by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed under the conditions of 170° C. and 1 minute to obtain a knitted fabric.

The performances of the knitted fabric obtained were evaluated, and the results are shown in Table 1. The knitted fabric of the present invention having a high elastic yarn content exhibited an instantaneous heat generation temperature of 1.0° C. or more when stretched and thus was the target knitted fabric, and the ratio of dimensional change due to washing was −2.2% in warp and −1.9% in weft, revealing that this was a product that did not lose shape even when worn or washed as a garment.

Comparative Example 2

A knitted fabric was produced in the same manner as in Example 8 except for changing the elastic yarn to 22 dtex (Roica SF, trade name, produced by Asahi Kasei Fibers Corporation) and organizing all the structure by a plain stitch, and the performances of the knitted fabric obtained were evaluated. The results are shown in Table 1. Also, the ratio of dimensional change due to washing was −3.9% in warp and −4.8% in weft, revealing that this was a product that readily lost shape due to wearing or washing as a garment.

Example 9

Using a single circular knitting machine with 28 gauge, an elastic yarn of 78 dtex (Roica SF, trade name, produced by Asahi Kasei Fibers Corporation) and an ester textured yarn of 56 dtex/24f were prepared, and these yarns were organized in the following structure of repeating a knit loop and a welt loop by plating knitting (K indicates knit and W indicates welt).

| | | | | | |
|---|---|---|---|---|---|
| Knit structure: | knitting order 1: | K | W | K | W |
| | knitting order 2: | K | W | K | W |
| | knitting order 3: | W | K | W | K |
| | knitting order 4: | W | K | W | K |

The knitted fabric organized was relaxed and scoured by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed under the conditions of 170° C. and 1 minute to obtain a knitted fabric.

The performances of the knitted fabric obtained were evaluated, and the results are shown in Table 1. The knitted fabric of the present invention exhibited an instantaneous heat generation temperature of 1.0° C. or more when stretched and thus was the target knitted fabric, and the ratio of dimensional change due to washing was −1.3% in warp and −2.1% in weft, revealing that this was a product that did not lost shape even when worn or washed as a garment.

Example 10

Using a pantyhose knitting machine having a cylinder size of 4 inch and a number of needles of 400, a covering yarn obtained by winding a nylon textured yarn of 13 dtex/7f around an elastic yarn of 44 dtex (Roica SF, trade name, produced by Asahi Kasei Fibers Corporation) was used and organized in a tuck stitch structure of repeating a knit loop and a tuck loop.

The knitted fabric organized was scoured and dyed by a paddle dyeing machine, and after the dyeing, a softener and a water absorbent were added and then the knitted fabric was dried. Thereafter, the knitted fabric was set in a foot frame and subjected to steam setting at 120° C. for 30 seconds to obtain a knitted fabric.

The performances of the knitted fabric obtained were evaluated, and the results are shown in Table 1. The knitted fabric of the present invention, where the structure was different from that of a normal pantyhose and the mixed ratio of elastic yarn was high, exhibited an instantaneous heat generation temperature of 1.0° C. or more when stretched and thus was the target knitted fabric. The ratio of dimensional change due to washing was −2.4% in warp and −2.5% in weft, revealing that this was a product that did not lose shape even when worn or washed as a garment.

Example 11

Using a tricot warp knitting machine with 36 gauge, an elastic yarn of 44 dtex (Roica SF, trade name, produced by Asahi Kasei Fibers Corporation) and a nylon original yarn of 33 dtex/36f were prepared for the back reed and the front reed, respectively, and a knitted fiber was organized according the following structures and conditions.

Front reed: 10/23

Back reed: 12/10

The knitted fabric organized was relaxed and scoured by a continuous scouring machine, preset at 190° C. for 1 minute by adjusting the width and length to give almost the same density as the density of the gray fabric, and thereafter, subjected to dyeing of nylon by a liquid flow dyeing machine. After the dyeing, a softener was padded, and finish setting was performed at 170° C. for 1 minute with the same density as that in the presetting to obtain a knitted fabric.

The knitted fabric obtained had a special structure, where the mixed ratio of the elastic yarn was 41% and higher than that of the normal tricot knitted fabric and where the content of elastic yarn and the power of knitted fabric were high and the elongation degree of knitted fabric was low. The performances of this knitted fabric were evaluated, and the results are shown in Table 1. The knitted fabric of the present invention exhibited an instantaneous heat generation temperature of 1.0° C. or more when stretched and thus was the target knitted fabric, and the ratio of dimensional change due to washing was −0.2% in warp and −0.9% in weft, revealing that this was a product that did not lose shape even when worn or washed as a garment.

Examples 12 and 13 and Comparative Example 3

The knitted fabric was finished by changing the density at the presetting in Example 1.1, and in Comparative Example 3, the knitted fabric was finished under the conditions employed in the production of normal knitted fabric. The performances of finished knitted fabrics are shown in Table 1. In Examples 12 and 13, the ratio of dimensional ratio due to washing of the knitted fabric was from −0.3 to −0.4% in warp and from −0.5 to −0.7% in weft, revealing that this was a product not losing the shape even when worn or washed as a garment. In the garment according to Comparative Example 3, the heat generation temperature during stretching was low, and the ratio of dimensional change due to washing was −3.1% in warp and −3.6% in weft and thus, this was a product that readily lost shape due to wearing or washing.

Example 14

A knitted fabric was produced in the same manner as in Example 1 except that a polyurethane polymer used in Example 4 of Japanese Unexamined Patent Publication No. 7-316922 was prepared and an elastic yarn differing in the power was produced by adding 4.0 wt % of the polymer to the spinning bath at the production of the elastic yarn of 44 dtex (Roica CR, trade name, produced by Asahi Kasei Fibers Corporation) and used, and evaluations were performed. The results are shown in Table 1.

The ratio of dimensional change due to washing of the knitted fabric obtained was −1.2% in warp and +0.3% in weft and thus, this was a product that did not lost shape even when worn or washed as a garment.

TABLE 1

| | Elastic Yarn Content ($g/m^2$) | Lb/La (Warp/Weft) | Power of Knitted Fabric (N) | Stretch-Heat Generation Index | Power of Elastic Yarn (cN/dtex) | Elongation Degree of Knitted Fabric (%) | Sum of Warp and Weft Elongation Degrees (%) | Fixing of Elastic Yarns Each Other | Direction of Knitted Fabric and Instantaneous Heat Generation Temperature (° C.) |
|---|---|---|---|---|---|---|---|---|---|
| Example 1 | 62 | 1.5/1.2 | 3.1 | 1.5 | 0.05 | 125 | 252 | A | warp, 2.3 |
| Example 2 | 52 | 1.4/1.4 | 3.0 | 0.9 | 0.05 | 179 | 260 | A | warp, 1.8 |
| Example 3 | 73 | 1.6/1.6 | 4.2 | 3.8 | 0.05 | 80 | 194 | A | warp, 2.5 |

TABLE 1-continued

| | Elastic Yarn Content ($g/m^2$) | Lb/La (Warp/Weft) | Power of Knitted Fabric (N) | Stretch-Heat Generation Index | Power of Elastic Yarn (cN/dtex) | Elongation Degree of Knitted Fabric (%) | Sum of Warp and Weft Elongation Degrees (%) | Fixing of Elastic Yarns Each Other | Direction of Knitted Fabric and Instantaneous Heat Generation Temperature (° C.) |
|---|---|---|---|---|---|---|---|---|---|
| Example 4 | 62 | 1.7/1.7 | 5.9 | 3.6 | 0.17 | 101 | 177 | A | warp, 3.2 |
| Example 5 | 62 | 1.7/1.6 | 5.0 | 2.8 | 0.14 | 111 | 198 | A | warp, 3.0 |
| Example 6 | 56 | 1.8/1.7 | 4.0 | 2.0 | 0.05 | 114 | 233 | A | warp, 2.4 |
| Example 7 | 65 | 1.8/1.6 | 4.3 | 2.8 | 0.05 | 101 | 188 | A | warp, 2.6 |
| Example 8 | 48 | 1.3/1.4 | 2.7 | 0.8 | 0.05 | 168 | 398 | A | weft, 1.9 |
| Example 9 | 61 | 1.5/1.6 | 3.9 | 1.6 | 0.05 | 151 | 314 | A | weft, 2.2 |
| Example 10 | 43 | 1.4/1.5 | 2.6 | 0.6 | 0.05 | 184 | 434 | A | weft, 1.4 |
| Example 11 | 58 | 1.5/1.3 | 3.1 | 1.4 | 0.05 | 133 | 298 | A | warp, 1.9 |
| Example 12 | 55 | 1.8/1.6 | 6.2 | 3.9 | 0.05 | 88 | 192 | A | warp, 3.5 |
| Example 13 | 60 | 1.3/1.2 | 2.9 | 1.2 | 0.05 | 142 | 312 | A | warp, 1.6 |
| Example 14 | 63 | 1.7/1.7 | 4.8 | 2.5 | 0.14 | 120 | 231 | A | warp, 2.8 |
| Comparative Example 1 | 37 | 1.2/1.2 | 2.1 | 0.4 | 0.05 | 208 | 302 | B | warp, 0.6 |
| Comparative Example 2 | 22 | 1.1/1.1 | 1.7 | 0.2 | 0.05 | 231 | 366 | B | weft, 0.4 |
| Comparative Example 3 | 61 | 1.1/1.0 | 1.7 | 0.4 | 0.05 | 233 | 345 | B | warp, 0.7 |

INDUSTRIAL APPLICABILITY

The knitted fabric of the present invention is a knitted fabric instantaneously exhibiting a temperature rise when the knitted fabric is stretched during athletic motion or sweating, and by sewing this knitted fabric to a garment covering the joint region, specifically, bottoms such as sports tights, spats, compression tights and girdle, tops such as underwear, shirt and compression shirt, legs such as pantyhose, socks, tights and leggings, supporters such as knee supporter, elbow supporter, arm cover, leg cover, knee cover and elbow cover, and gloves, a garment keeping the wearer warm is obtained, due to heat generation of the knitted fabric during wear or athletic motion.

DESCRIPTION OF REFERENCE NUMERALS

1: Needle loop of non-elastic yarn
2: Starting point of needle loop
3: Ending point of needle loop
4: Sinker loop of elastic yarn
5: Starting point of sinker loop
6: Ending point of sinker loop

The invention claimed is:

1. A stretchable knitted fabric comprising a non-elastic yarn and an elastic yarn, wherein the instantaneous heat generation temperature when stretched by 100% in at least one of warp and weft directions of the knitted fabric is 1.0° C. or more, the elastic yarn is contained in an amount of 40 $g/m^2$ or more and the power of knitted fabric stretched by 95% in at least one of warp and weft directions of the knitted fabric, as measured by the following method, is 2.5 N or more:

Measurement of power of knitted fabric stretched by 95%:

the knitted fabric in the state of being stretched by 30% of the initial length is set on a Tensilon tensile tester and assuming that the stress value here is 0, the stress value (N) when further stretched by 50% based on the lenth at the setting (stretched by 95% in all of the initial length of the knitted fabric) is measured and taken as the power of knitted fabric stretched by 95%, the ratio (Lb/La) between the length La obtained by adding the length of sinker loop of the elastic yarn and the length of needle loop of the non-elastic yarn in one unit of the knit structure when the knitted fabric is stretched by 30% in both wrap and weft directions, and the length Lb obtained by adding the length of sinker loop of the elastic yarn and the length of needle loop of the non-elastic yarn in one unit of the knit structure when the knitted fabric is further stretched in either one of warp and weft directions to 50% stretch satisfies the following formula (1):

$$1.2 \leq Lb/La \leq 1.8 \quad (1)$$

the elongation degree of knitted fabric in the direction causing stretch-heat generation is from 70 to 200% and the sum of warp and weft elongation degrees of the knitted fabric is from 170 to 450%, under load of 9.8 N.

2. The stretchable knitted fabric according to claim 1, wherein the stretch-heat generation index represented by the following formula is from 0.5 to 4.0:

Stretch-heat generation index=(weight of elastic yarn×power of knitted fabric stretched by 95%)/elongation degree of knitted fabric (wherein the weight of elastic yarn is the weight ($g/m^2$) of elastic yarn per unit area of the knitted fabric, the power of knitted fabric stretched by 95% is the power (N) of knitted fabric stretched by 95% as measured by the method above, and the elongation degree of knitted fabric is the elongation degree (%) of knitted fabric under a load of 9.8 N/knitted fabric of 2.5 cm in width).

3. The stretchable knitted fabric according to claim 1, wherein at least a part of the elastic yarn is organized in a looping structure.

4. The stretchable knitted fabric according to claim 1, wherein the elastic yarns are fixed to each other at the intersection of the elastic yarns.

5. The stretchable knitted fabric according to claim 1, wherein the power of the elastic yarn stretched by 100% is from 0.04 to 0.20 cN/dtex.

6. A garment obtained by using the stretchable knitted fabric according to claim 1, which closely attaches to a body to cover at least a joint region.

7. The garment according to claim 6, wherein the garment is at least one member selected from bottoms, tops, legs, supporters and gloves.

* * * * *